US006230769B1

(12) United States Patent
O'Brien

(10) Patent No.: US 6,230,769 B1
(45) Date of Patent: May 15, 2001

(54) TAP-HANDLE-ASSEMBLY EXTENSION TO FACILITATE ONE-HANDED OPERATION OF BEVERAGE TAPS

(76) Inventor: Denis Richard O'Brien, P.O. Box 544, Charlottesville, VA (US) 22902

( * ) Notice: Subject to any disclaimer, the term of this patent is extended or adjusted under 35 U.S.C. 154(b) by 0 days.

(21) Appl. No.: 09/408,205

(22) Filed: Sep. 29, 1999

(51) Int. Cl.[7] ..... B67D 5/00

(52) U.S. Cl. ..... 141/362; 141/369; 222/505; 137/378; 251/293

(58) Field of Search ..... 141/369, 370, 141/372, 373, 360–362, 392; 137/378; 251/291, 293; 222/505, 509, 517, 518

(56) References Cited

U.S. PATENT DOCUMENTS

| | | | | |
|---|---|---|---|---|
| 737,767 | * | 9/1903 | Pigrenet | 251/293 |
| 756,915 | * | 4/1904 | Tuor | 137/378 |
| 1,087,403 | * | 2/1914 | Scott | 137/378 |
| 1,512,017 | * | 10/1924 | Field | 41/362 |
| 2,058,631 | * | 10/1936 | Rice | 251/291 |
| 4,111,243 | * | 9/1978 | Fetterman | 141/362 |
| 4,138,092 | * | 2/1979 | Apellaniz | 141/362 |
| 4,245,682 | * | 1/1981 | Agnew, Sr. | 141/392 |
| 4,252,160 | * | 2/1981 | Numbers | 141/362 |

* cited by examiner

*Primary Examiner*—J. Casimer Jacyna
(74) *Attorney, Agent, or Firm*—Denis R. O'Brien

(57) ABSTRACT

In a beverage tap of the kind used in ale houses, pubs and restaurants, a tap-handle-assembly extension is provided that facilitates the operation of the tap with one hand so that the server can easily fill two receptacles from two taps simultaneously without wasting beverage. Disclosed embodiments include an extension that may be reversibly retrofitted to an existing tap, an extension that is incorporated into the structure of a tap handle, and an extension that is connected to and contiguous with an upper retaining nut.

11 Claims, 4 Drawing Sheets

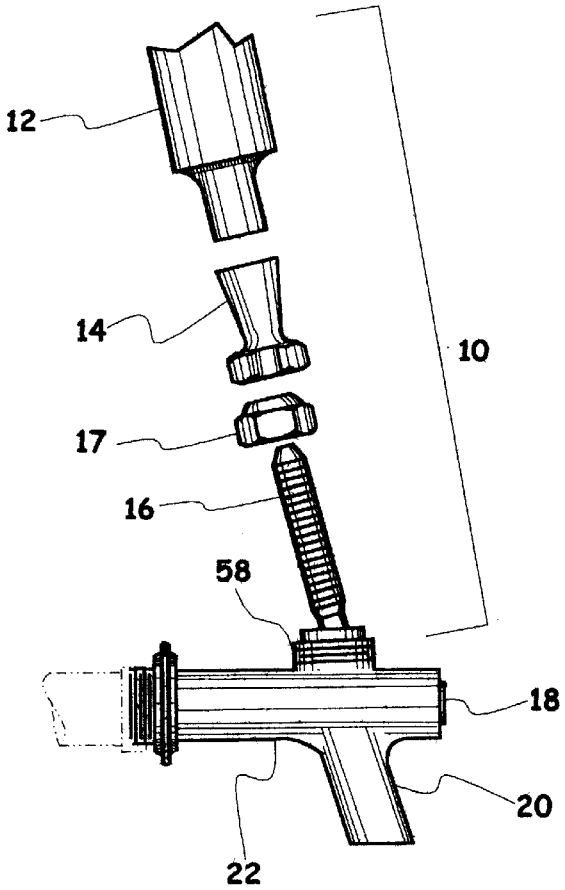
Fig. 1-A
Prior Art
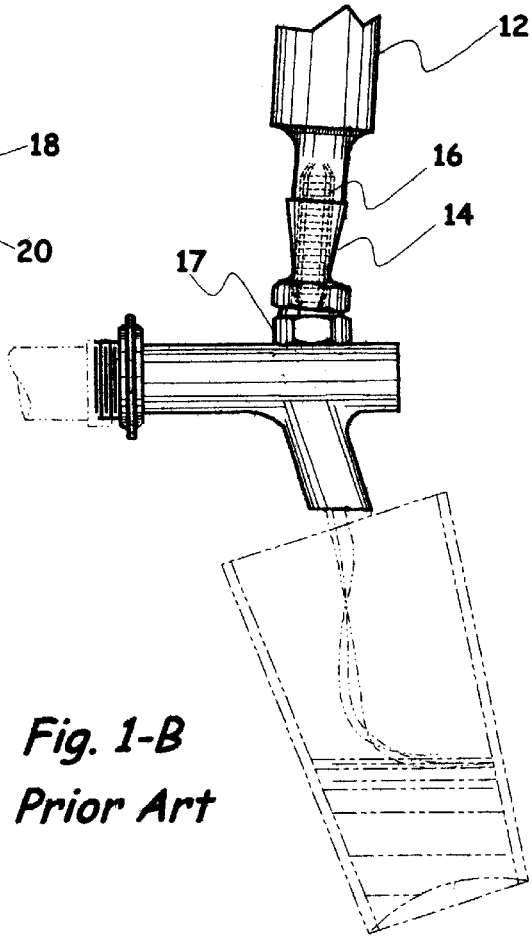
Fig. 1-B
Prior Art

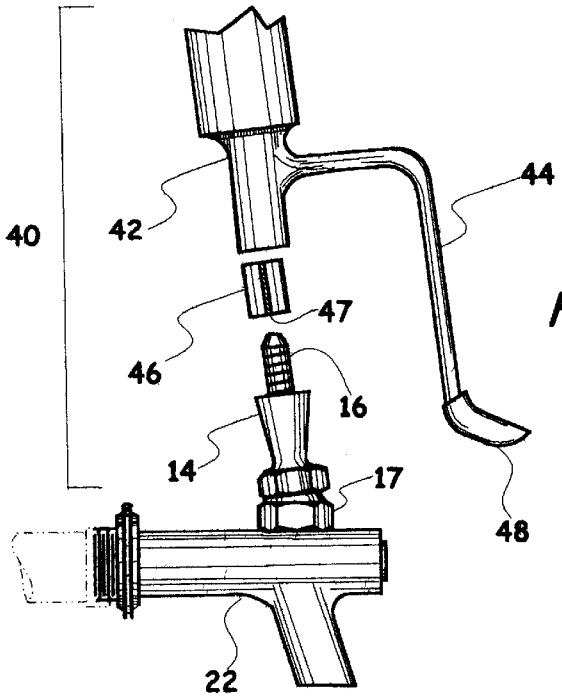
Fig. 4-A
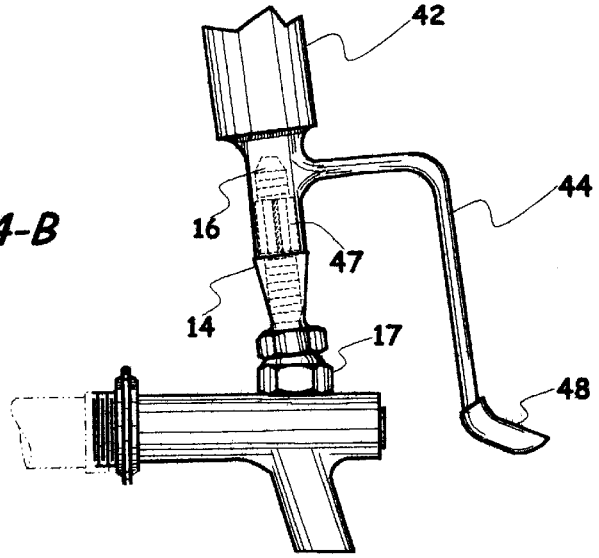
Fig. 4-B

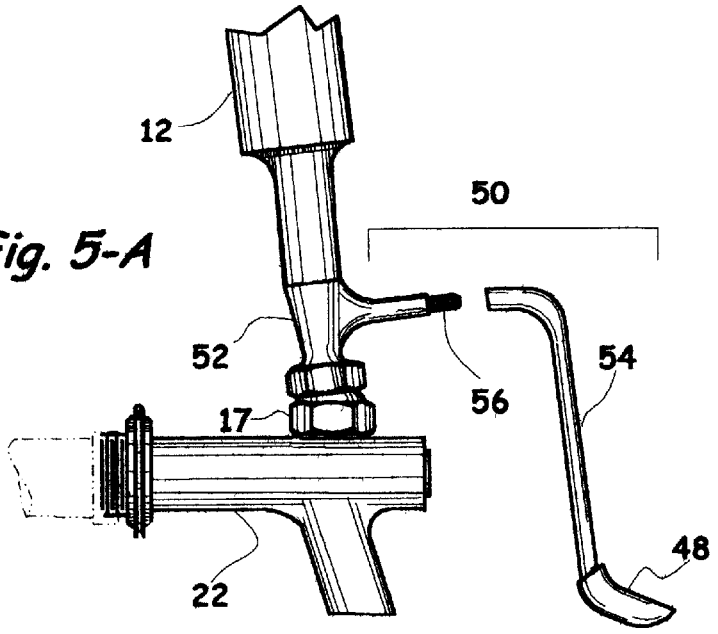
Fig. 5-A
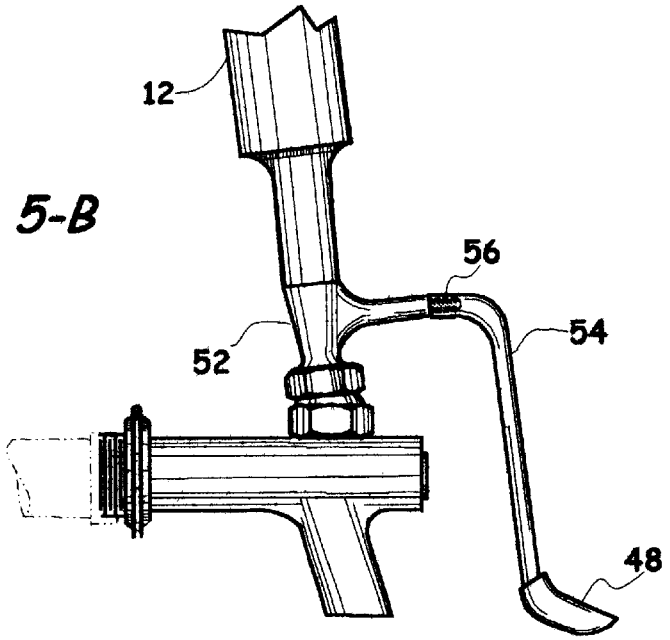
Fig. 5-B

TAP-HANDLE-ASSEMBLY EXTENSION TO FACILITATE ONE-HANDED OPERATION OF BEVERAGE TAPS

BACKGROUND OF THE INVENTION

1. Field of the Invention

This invention relates to valve assemblies, commonly called "taps," used to dispense beverages, particularly beverages stored under pressure, such as draft beer.

2. Description of the Prior Art

Many bars, taverns, pubs, ale houses and restaurants dispense beverages by means of pressurized storage and delivery systems controlled by valve assemblies commonly called "taps." Taps, which may be mounted on a wall, or connected to a counter-top by means of a stanchion, communicate with storage containers of beverage via conduits and control the flow of beverage from the storage container to the receptacles in which the beverage is served.

Taps comprise a tap valve that is controlled by a tap-handle assembly. Most tap valves are actuated by a to-and-fro movement of a vertically-oriented tap-handle assembly, as described in detail below. In order to open the valve and dispense beverage, the tap-handle assembly is pulled forward, toward the server. To close the tap, the tap-handle assembly is pushed away from the server.

In addition to providing a mechanism for actuating tap valves, the exterior parts of tap-handle assemblies are shaped and painted in unique ways in order to indicate the brand of the beverage that is being dispensed from the tap.

SUMMARY OF THE INVENTION

Shortcomings of Prior Art That Are Overcome by the Invention

Taps of various types have been in use for many generations; however, they share one persistent shortcoming: they are difficult or impossible to operate with one hand. This shortcoming is particularly troublesome during periods when business is brisk because it is at such times that it is desirable to fill two receptacles simultaneously—holding one receptacle in each hand under separate taps—thus effectively doubling the rate at which beverage is delivered to the customers. However, many servers find it impossible to operate a tap with the same hand that holds the glass or pitcher to be filled. Even if two taps can be opened and two receptacles can be filled in this manner, it is often necessary to put down one receptacle that has been filled in order to have a free hand with which to close the taps. During this maneuver, beverage is lost due to spillage and over-filling. Consequently, over the course of a busy evening there is a substantial loss of beverage and a concomitant loss in profits.

For these reasons it would be desirable and commercially beneficial to have a means of opening and closing taps with one hand while holding the receptacle to be filled with that hand.

OBJECTS OF THE INVENTION

A first object of the invention is to provide a means and a mechanism for opening and closing a tap easily with one hand while simultaneously holding a receptacle with the same hand;

A second object of the invention is to provide a means and a mechanism for reducing the spillage of beverage that occurs when a server attempts to operate a tap with one hand;

A third object of the invention is to provide a means to identify the beverage that is being dispensed by a particular tap.

BRIEF DESCRIPTION OF THE DRAWINGS

The above and other objects, features and advantages of the invention will become more apparent from the descriptions below, taken in connection with the accompanying drawings:

FIG. 1-A is a side elevation of a typical prior-art tap in the closed position, showing the components of the tap-handle assembly;

FIG. 1-B is a side elevation of the typical prior-art tap shown in FIG. 1-A, assembled and in the open position;

FIG. 4-A is a side elevation of a tap showing the component parts of an improved tap handle, which is one embodiment of the present invention;

FIG. 4-B is a side elevation of a tap showing the improved tap handle of FIG. 4-A assembled;

FIG. 5-A is a side elevation of a tap showing the component parts of an improved upper retaining nut, which is one embodiment of the present invention;

FIG. 5-B is a side elevation of a tap showing the improved upper retaining nut of FIG. 5-A assembled.

Figure 2:
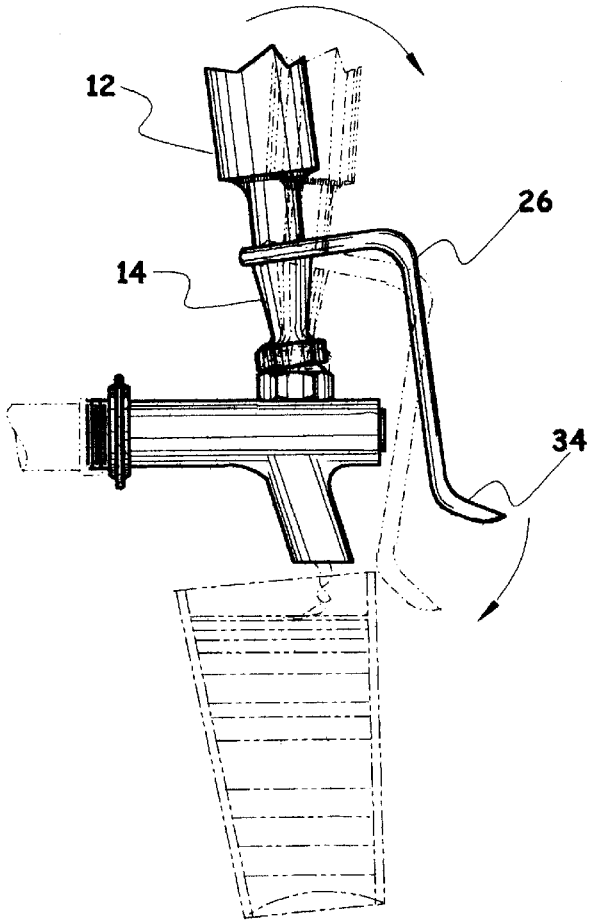
FIG. 2 is a side elevation of one embodiment of the invention showing the operation of the tap with the invention in place.

All drawings are oriented so that the server would be standing to the right and beverage would flow though the tap from left to right when the tap is open.

DETAILED DESCRIPTION OF PREFERRED EMBODIMENTS

REFERENCE NUMERALS USED IN THE DRAWINGS

| | |
|---|---|
| 10 | tap-handle assembly |
| 12 | tap handle |
| 14 | upper retaining nut |
| 16 | handle-stud |
| 17 | lower retaining nut |
| 18 | piston |
| 20 | spout |
| 21 | faucet casing |
| 26 | retrofit tap-handle-assembly extension |
| 28 | retrofit tap-handle assembly extension |
| 30 | connector hole |
| 32 | display means |
| 40 | improved tap-handle assembly |
| 42 | improved tap handle |
| 44 | tap-handle-assembly extension |
| 45 | key |
| 46 | adapter bushing |
| 47 | key channel |
| 48 | cushion |
| 50 | modified upper-retaining-nut assembly |
| 52 | modified upper retaining nut |

-continued

| DETAILED DESCRIPTION OF PREFERRED EMBODIMENTS REFERENCE NUMERALS USED IN THE DRAWINGS | |
|---|---|
| 54 | upper retaining nut extension |
| 56 | upper-retaining-nut stud |
| 58 | annulus |

DESCRIPTION OF STRUCTURAL FEATURES AND FUNCTIONAL RELATIONSHIPS OF COMPONENT PARTS

FIGS. 1-A and 1-B are side elevations of a typical tap, showing such a tap in the closed (FIG. 1-A) and open (FIG. 1-B) positions.

FIG. 1-A shows the various component parts of a tap that are relevant to the present invention. A cylindrical faucet casing 22 has a bore (not shown) through which beverage passes to the spout 20 when a ball-type valve (not shown) within the bore is open. A piston 18, which is controlled by a tap-handle assembly 10, travels to and fro within the bore of faucet casing 22. The anterior end of piston 18 protrudes from the casing when the tap is in the closed position, as is depicted in FIG. 1-A. The posterior end of the piston (not shown) forms the ball of the ball-valve. When the tap is closed, this ball is seated against the faucet bore and the flow of fluid though the bore is occluded. When the piston with its ball-end is moved toward the rear of the tap by the forward movement of the tap-handle assembly 10, the beverage flows through the valve, into the bore of the faucet casing 22 and out through the spout 20.

Tap handle-assemblies may take a number of forms, but their function is the same; to act as a lever by which the server can open and close the tap valve. The exploded tap-handle assembly 10 shown in FIG. 1 is typical of the prior art. Tap-handle assembly 10 includes an externally threaded handle-stud 16 attached at its lower end (not shown) to piston 18. An internally-threaded lower retaining nut 17 fits over the handle-stud 16 and mates with a externally threaded annulus 58 in the faucet casing. A second internally threaded retaining nut, referred to herein as the upper retaining nut 14, is screwed onto the handle-stud 16 until it fits snugly against the lower retaining nut 17, leaving part of the handle-stud extending past the upper surface of the upper retaining nut. An internally threaded tap handle 12 is screwed onto the remaining exposed part of the handle-stud 16. (Only the lower portion of the tap handle 12 is shown in the diagrams.)

FIG. 1-B shows a fully assembled tap in the open position. By comparing FIG. 1-A to FIG. 1-B, it can be seen that the tap-handle assembly must be pulled forward approximately 10°–20° in order to open the tap valve.

Tap handles vary in size, shape and color according to the brand of beverage that is being dispensed, but they are typically elongate structures having an outside diameter of about 30 mm and a length of approximately 300 mm. Because tap handles have internally threaded connectors in their lower ends (not shown) that mate with the upper end of the handle-stud 16, they can be readily removed and exchanged with one another. This permits the appropriate handle to be employed when a tap is connected to a keg containing a different brand of beer, the replacement handle then indicating the brand.

FIG. 2 depicts an embodiment of the invention in which a tap-handle assembly has been adapted with a tap-handle-assembly extension 26. This embodiment of the invention has the advantage that no modification of the components of the tap-handle assembly is required because the prior-art-tap-handle assembly 10 shown in FIG. 1-A can be easily retrofit with tap-handle-assembly extension 26.

FIG. 2 also shows the motion of the adapted tap-handle assembly as the tap is opened. This motion is characteristic of all embodiments of the invention, as discussed in the next section.

Figure 3:
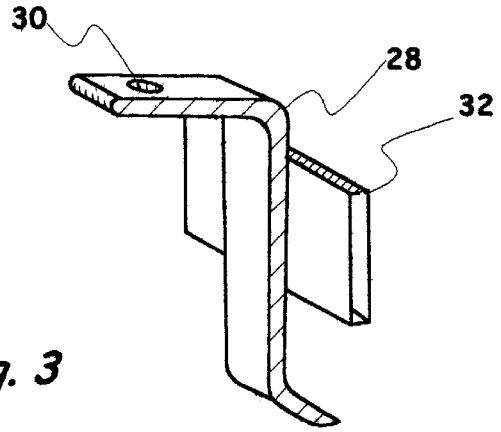
FIG. 3 is an isometric view of an embodiment of the present invention similar to that shown in FIG. 2, but with the addition of a display means.

The tap-handle-assembly extension 28 shown in isometric view in FIG. 3 is the same as tap-handle-assembly extension 26 but modified by the addition of a display means 32, discussed below. As can be seen, tap-handle-assembly extension 28 has a substantially horizontal upper portion and a substantially vertical lower portion. A wide variety of connectors are anticipated for attaching the tap-handle-assembly extension to the tap-handle assembly. The embodiment shown in FIG. 3 illustrates a simple connector: a connector-hole 30 that allows the tap-handle-assembly extension to be fitted over the handle-stud 16. As shown in FIG. 2, the tap handle 12, once screwed onto the handle-stud 16, secures the tap-handle-assembly extension 26 against upper retaining nut 14.

The embodiment of the invention shown in FIG. 3 includes a display means 32 attached to the lower portion of the tap-handle-assembly extension 28. The display means is used to display small signs indicating the brand of the beverage being dispensed or other information, such as advertising. Such a display means can be incorporated in all embodiments of the invention.

FIG. 4-A depicts another embodiment of the present invention: a modified tap-handle assembly 40 in which a tap handle 42 is modified so as to have a tap-handle extension 44 incorporated into its structure. The adaptation of the tap handle can be better visualized by comparing the conventional tap handle 12 of FIG. 1-A with the modified tap handle 42 of FIG. 4-A.

A connector is required in this embodiment that will permit the attachment of the modified tap handle 42 to the tap-handle-assembly. Unlike the conventional tap handle, the modified tap handle 42 has no internal threads in its lower end. Rather, an internally threaded adapter bushing 46 is screwed onto the handle-stud 16 until the adapter bushing is flush against the upper retaining nut 14. The tap handle 42 is then slid down onto the adapter-bushing 46. A key-channel 47 in the adapter bushing 46 communicates with an internal key 45 in the handle 42. This prevents the handle from rotating on the adapter bushing during operation of the tap.

FIG. 4-B shows the assembly tap-handle assembly of FIG. 4-A. It should be noted that the upper retaining nut 14 used in this embodiment is of the conventional type shown in the diagrams of the prior art at FIGS. 1-A and 1-B.

FIG. 5-A depicts an upper-retaining-nut assembly 50 embodiment of the present invention in which the upper retaining nut 52 is adapted so as to receive a removable upper-retaining-nut extension 54. The adaptation can be better visualized by comparing the conventional upper retaining nut 14 of FIG. 1-A with the modified upper retaining nut 52 of FIG. 5-A. The removable upper-retaining-nut extension 54 is substantially round in cross-section and has a hollow, internally threaded upper end by which it connects to the upper retaining nut 52 by a connector: an externally threaded upper-retaining-nut stud 56 that protrudes from the modified upper retaining nut 52. (Alternatively, the upper-retaining-nut stud could protrude from the upper-retaining-nut extension 54 and mate with internal threads in the upper-retaining nut 52.)

FIG. 5-B shows the embodiment of FIG. 5-A assembled. It should be noted that in this embodiment the beverage handle 12 is of the convenient type shown in the diagrams of the prior art at FIGS. 1-A and 1-B, it being an advantage of this embodiment that the conventional tap handle need not be altered.

It will be noted that the various extension devices shown in FIGS. 2, 3, 4-A, 4-B, 5-A and 5-B have a curved lower end. In addition, FIGS. 4-A, 4-B, 5-A and 5-B show how a rubberized cap or cushion 48 fitted to the lower end of the extension device, but which may extend well up the length of the extension device. Such a cushion is anticipated regardless of whether or not the lower end of the extension device is curved.

DESCRIPTION OF OPERATION OF THE INVENTION

From the prior art shown in FIGS. 1-A and 1-B, the difficulty in operating a tap with only one hand may be appreciated. In order to open the tap, the tap-handle assembly must be pulled forward from the position shown in FIG. 1-A to the position shown in FIG. 1-B, while simultaneously holding the receptacle in position to catch the beverage that flows from the spout 20. In order to do this, the server must hold the receptacle with four fingers, reach up with the index finger, wrap the index finger around the bottom portion of the upper retaining nut 14, and pull the entire tap-handle assembly forward to the position shown in FIG. 1-B. When filling two receptacles, this complex maneuver must be carried out with both hands simultaneously.

Closing the taps after filling two receptacles is even more difficult. The server—now holding two full receptacles of beverage—must use each index finger to apply pressure to the forward aspect of respective lower retaining nuts 14 and thereby push the tap handle-assemblies away from the server. Not surprisingly, beverage is often split during this maneuver. For servers with small hands, closing two taps simultaneously is all but impossible, in which case the server must put down one of the full receptacles and use the free hand to quickly close both taps. Even when the server has large hands and enviable dexterity, some tap handles are so heavy that moving them to and fro with one finger is not easily done without spilling beverage. Consequently, a lot of beverage goes down the drain when servers attempt to fill two receptacles simultaneously to satisfy the demands of thirsty, inebriate customers.

By understanding the operation of the invention as shown in the preferred embodiments of FIGS. 2, 3, 4-A, 4-B, 5-A and 5-B the reader will discover how the invention overcomes the foregoing difficulties.

FIG. 2 shows a conventional tap-handle assembly modified by the addition of a retrofit tap-handle-assembly extension 26, such as one 28 shown in isometric view in FIG. 3. When such a tap-handle-assembly extension is fitted to a tap-handle assembly, it facilitates the difficult task of operating the tap with one hand while simultaneously holding a receptacle—the server simply presses down on the tap-handle-assembly extension to open the valve and pushes up on the tap-handle-assembly extension to close the valve.

The embodiments depicted by FIGS. 2 and 3 include a flared portion 34 of the lower end of the tap-handle-assembly extension that makes this action even easier. Downward pressure on the flared portion 34 causes the tap-handle assembly to tilt forward, thereby opening the valve. Once the receptacle is full, the edge of the receptacle is used to apply pressure to the back side of the tap-handle-assembly extension, as shown in FIG. 2, thus causing the end of the tap-handle-assembly extension 34 to move in an upward direction, the tap-handle assembly to move backwards, and the tap valve to close. In this manner even servers with small hands can move the tap-handle assembly to and fro easily.

It will readily be appreciated from FIG. 3 how the particularly simple and utilitarian form of this embodiment ensures its easy and economic construction from metal, plastic, rubber, or any rigid or semi-rigid material.

The retrofit tap-handle-assembly extension 28 shown in FIG. 3 demonstrates an additional useful feature: a display means 32. Many embodiments of such a display means are possible and anticipated, for instance, a hollow placard holder having an open edge through which a small placard can be inserted, and a transparent face through which the placard can be seen. Alternatively, a solid ferrous structure may be employed to which a placard may be attached magnetically. Or a small "white-board" may be employed, upon which information can be written in erasable ink. It is also anticipated that the placard holder may have a self-contained battery or other source of power and a means for illuminating the placard and/or the tap. In any case, the function of the display is the same: to provide a means of using the tap-handle-assembly extension 28 to present information about the tap-system itself, such as "empty."

FIG. 4-A and 4-B illustrate an embodiment of the invention in which the tap handle 42 incorporates a tap-handle extension 44 in the structure of the tap handle.

One difficulty with this approach is that a tap handle with such a tap-handle extension cannot be screwed onto the handle-stud because during this operation the lower portion of the tap-handle extension is not able to get around the faucet casing 22. In order to overcome this difficulty, a connector is required, such as adapter bushing 46, which is provided with internal threads that mate with the threads of the handle-stud 16. One assembles this embodiment by first screwing the upper retaining nut 14 down onto the handle-stud 16 so that it fits snugly against the lower retaining nut 17. Next, adapter bushing 46 is screwed down onto the upper retaining nut 14, and the modified tap handle 42 is slid down onto the adapter bushing. Unlike a conventional tap handle, the modified tap handle of this embodiment has a smooth, non-threaded bore so that it slides over the adapter bushing. In order to prevent the tap handle from twisting on the adapter bushing during operation, a key 45 is provided in the bore of the tap handle, which 45 engages a key channel 47 provided in the adapter bushing 46. Tap handles that have been modified in this way can be exchanged quite easily by sliding them on and off of the adapter bushing. However, conventional tap handles can also be used by removing the adaptor bushing 46 from the handle-stud 16. It should be noted that the handle-stud 16 and the upper retaining nut 14 are conventional and need not be modified in this embodiment.

FIG. 4-B shows this embodiment of the invention assembled. Pushing down on tap-handle extension 44 with but a single finger causes the entire tap-handle assembly 40 to move forward, thereby opening the tap valve. Pushing upwards on the back-side of tap-handle assembly 44 with the upper edge of the filled receptacle causes the entire tap handle assembly 40 to move backward, thus closing the tap valve.

FIGS. 5-A and 5-B show another preferred embodiment of the invention: a modified upper retaining nut, including an upper-retaining-nut extension and a connector. In this embodiment, an upper-retaining-nut assembly 50 comprises an upper retaining nut 52 modified to receive a removable upper-retaining-nut extension 54, which has internal threads in its upper end so that it can mate with an upper-retaining-nut stud 56 protruding from the upper retaining nut 52. With this embodiment, the tap-handle assembly with the modified upper retaining nut 52 is assembled by removing upper-retaining-nut extension 54 from the upper retaining nut 52 and screwing upper retaining nut 52 onto the handle-stud 16 (shown in FIG. 1-A) so that it fits snugly against lower retaining nut 17. The tap handle 12, which is the conventional type shown in FIG. 2, is then screwed onto the handle-stud until it fits snugly against the upper retaining nut 52. Finally, upper-retaining-nut extension 54 is replaced by screwing it onto the upper-retaining-nut stud 56. The assembled tap-handle assembly is shown in FIG. 5-B.

The embodiment shown in FIG. 5-B operates in a manner that is identical to the embodiment shown in FIG. 2. The tap is opened with one finger by pressing down on the lower end of upper-retaining-nut extension 54. The tap is closed by using the edge of the receptacle to apply upward pressure to the back of upper-retaining-nut extension 54.

An additional refinement of the invention demonstrated in FIGS. 4-A, 4-B, 5-A and 5-B is a cushion 48 fitted to the lower end of the respective extensions 26, 44, and 54. Such a cushion may be made of any resilient, protective material, such as rubber or plastic. It is convenient and economically useful to have such a cushion—especially with embodiments of the invention cast in metal—to avoid the scratching, chipping or breaking of glass receptacles when using the edge thereof to turn the tap off, as discussed above.

SUMMARY, RAMIFICATIONS, AND SCOPE OF THE DISCLOSURE

Accordingly, the reader will appreciate how the invention disclosed herein facilitates the one-handed operation of taps. Furthermore, it will be appreciated that this invention provides a number of economic advantages:

- it effectively doubles the rate at which beverages can be dispensed;
- it permits all servers, large and small, to easily fill two receptacles simultaneously in spite of morphometric limitations of their digits;
- it minimizes the shameful spillage and waste of valuable liquid commodities;
- it provides a means for readily determining what beverage is being dispensed through which tap.

The foregoing descriptions disclose numerous details of how to make and use the invention; however, these descriptions should not be construed as limitations either of the scope or the anticipated embodiments of the invention but rather as disclosures of presently preferred embodiments of the invention. For instance, the connector used to connect the retrofit tap-handle-assembly extension shown in FIG. 3 to the tap-handle assembly could be a collar and set-screw mechanism, or the lower portion of the tap-handle-assembly extension shown in FIG. 3 could have a more oval or rounded cross-section.

Thus, the scope of the invention should be determined not by the preferred embodiments disclosed above, but by the following claims and their legal equivalents.

What is claimed is:

1. An improved tap of the type having:

(a) a faucet casing that encloses a bore though which beverage passes to a spout;

(b) an annulus in the faucet casing;

(c) a valve housed within the bore such that the opening and closing of the valve controls the flow of beverage through the bore to the spout;

(d) a tap-handle assembly having (i) a handle-stud with an upper end and a lower end, the lower end passing through the annulus and operably connecting to the valve such that the valve is opened and closed when the handle-stud is moved to-and-fro;

(ii) a lower retaining nut that fits over the upper end of the handle-stud and fastens to the annulus such that the handle-stud is secured to the faucet casing in a manner that permits the handle-stud to be moved freely to-and-fro;

(iii) an upper retaining nut secured to the handle-stud such that the upper most part of the handle-stud protrudes through the upper retaining nut;

(iv) a handle attached to the upper most part of the handle-stud;

the improvement comprising a tap-handle-assembly extension attached to the tap-handle assembly for facilitating to to-and-fro movement of the handle-stud, whereby one-handed operation of the tap is made easier.

2. An improved tap as claimed in claim 1, the improvement further comprising means for reversibly attaching said tap-handle-assembly extension to the tap-handle assembly.

3. An improved tap as claimed in claim 1, the improvement further comprising a display for displaying information, said display being integral to said tap-handle-assembly extension.

4. An improved tap as claimed in claim 1, wherein said tap-handle-assembly extension is an upper-retaining-nut extension attached to the upper retaining nut.

5. An improved tap as claimed in claim 4, the improvement further comprising a display for displaying information, said display being integral to said upper-retaining-nut extension.

6. An improved tap as claimed in claim 4, the improvement further comprising means for reversibly attaching said upper-retaining-nut extension to the upper retaining nut.

7. An improved tap as claimed in claim 4, the improvement further comprising:

(a) an upper-retaining-nut stud integral to and protruding from the upper retaining nut; and (b) means for reversibly attaching said upper-retaining-nut extension to said upper-retaining-nut stud.

8. An improved tap as claimed in claim 1, wherein said tap-handle-assembly extension is a tap-handle extension attached to the tap handle.

9. An improved tap as claimed in claim 8, the improvement further comprising a display for displaying information, said display being integral to said tap-handle extension.

10. An improved tap as claimed in claim 8, the improvement further comprising means for reversibly attaching said tap-handle extension to the tap handle.

11. An improved tap as claimed in claim 8, the improvement further comprising:

(a) an adapter bushing reversibly connected to the handle-stud;

(b) a key channel in the outer surface of said adapter bushing; and, (c) a key in the bore of the tap handle, said key mating with said key channel when the tap handle is slid onto said adapter bushing such that the tap handle is reversibly secured to the tap handle-stud.

* * * * *